United States Patent [19]

Ohashi

[11] Patent Number: 4,682,275

[45] Date of Patent: Jul. 21, 1987

[54] MOUNT STRUCTURES FOR SUSPENDER MEMBERS OF PORTABLE FLASHLIGHTS

[75] Inventor: Keiichi Ohashi, Shizuoka, Japan

[73] Assignee: Skylight Industry Co. Ltd., Japan

[21] Appl. No.: 861,408

[22] Filed: May 9, 1986

[30] Foreign Application Priority Data

Nov. 21, 1985 [JP] Japan ..... 60-262159

[51] Int. Cl.[4] ..... F21L 15/14

[52] U.S. Cl. ..... 362/191; 362/108; 362/109; 362/396

[58] Field of Search ..... 362/190, 191, 208, 391, 362/396, 399, 457, 157, 119, 108, 200, 202, 109; 224/904, 224, 253

[56] References Cited

U.S. PATENT DOCUMENTS

| | | | |
|---|---|---|---|
| 1,665,803 | 4/1928 | Veenschofen | 362/191 |
| 1,894,147 | 1/1933 | Barber | 362/396 |
| 1,977,086 | 10/1934 | Pryor | 362/208 |
| 2,147,471 | 2/1939 | Tyrnell et al. | 362/191 |
| 3,612,853 | 10/1971 | Aoki | 362/191 |

*Primary Examiner*—Charles J. Myhre
*Assistant Examiner*—D. M. Cox
*Attorney, Agent, or Firm*—Wegner & Bretschneider

[57] ABSTRACT

A mount structure for a suspender strap of a portable flashlight includes a female member integrally provided on the body of the flashlight and a male member detachably fitted over the female member by suitable means in a sliding fashion.

1 Claim, 4 Drawing Figures

MOUNT STRUCTURES FOR SUSPENDER MEMBERS OF PORTABLE FLASHLIGHTS

FIELD OF THE INVENTION

The present invention relates to a mount structure for a suspender member of a portable flashlight, which detachably connects a flashlight body with the suspender member.

BACKGROUND OF THE INVENTION

In the prior art flashlight, a suspender strap thereof is fixed to a body thereof. Therefore, when the suspender strap is attached to the waist belt of a user, the flashlight can only be used within the scope defined by the length of the suspender strap, thus offering a considerable disadvantage. For each use, to remove the strap from the waist belt is out of the question.

SUMMARY OF THE INVENTION

It is therefore a main object of the present invention to provide a mount structure for a suspender strap of a portable flashlight, which makes it possible to separate the suspender strap from the body of the flashlight, if required, without operating the suspender strap.

According to the present invention, this object is achieved by the provision of a mount structure for a suspender member of a portable flashlight, which includes a female member integrally provided on a body of the flashlight, which includes a female member integrally provided on a body of the flashlight and a male member detachably fitted in and over the female member in a sliding member, said female member having therein a retainer groove into which a first projection of said male member is slidingly fitted from one direction and a stopper member for limiting the movement of said projection, said male member having a second operable projection which can be locked in a locking hole formed in said female member in a state where said first projection is fitted into said retainer groove and restrained by said stopper member of said female member, said second operable projection being resiliently suported in such a manner that it can be engaged within or disengaged out of said locking hole, and being usually biased for locking within said locking hole, said male member being fixed relative to the female member with said second operable projection and stopper member in a state where said operable projection locked within said locking hole, and said male member having a hook member through which a desired suspender strap is inserted.

BRIEF DESCRIPTION OF THE DRAWINGS

For a better understanding of the invention, reference will now be made to the preferred embodiments thereof with reference to the accompanying drawings, which are given for the purpose of illustration alone, and in which.

Figure 1:
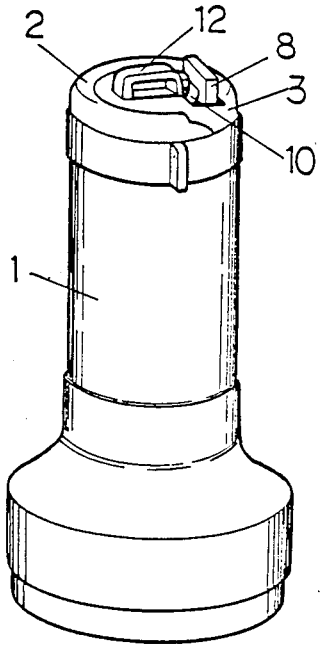
FIG. 1 is a perspective view showing a portable flashlight including the mount structure according to the present invention.

Referring to the drawings, the mount structure for a suspender strap according to the present invention comprises a female member 2 integrally attached to the rear end portion of, e.g., a grip of a flashlight body 1 and a male member 3 to be removably fitted in and over the female member 2 in a sliding manner.

The female member 2 includes a retainer groove 5 into which a projection 4 of the male member 3 is fitted from one direction and a stopper portion 6 to abut upon the projection 4 or any suitable portion of the male member 3 limiting the movement of the projection 4.

Figure 3:
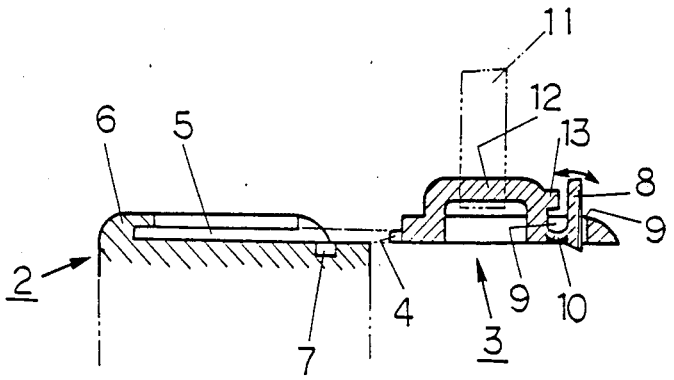
FIG. 3 is a sectional view taken along the line III—III of FIG. 2.

The male member 3 includes an operable projection 8 which can be fixed within a locking hole 7 formed in the female member 2 in a state where the projection 4 of the male member 3 is fitted into the retainer groove 5 in the female member 2, and is fixed by the stopper portion 6 of the female member 2. The operable member 8 is designed to extend vertically through a through-hole 9 in the male member 3, and is adapted to be resiliently supported by a leaf spring 10 of the male member 3 in such a manner that it engages within or disengages out of the hole 7. The leaf spring 10 constantly biases the operable projection 8 in such a manner that it is locked within the hole 7. In the instant embodiment, a bias is applied in such a manner that the lower end of the operable projection 8 projects downwardly and slightly from the bottom of the male member 3 (see FIGS. 3 and 4).

With the operable projection 8 and the stopper 6, the male member 3 is fixed at the given position relative to the female member 2 in a state where that projection is locked in the hole 7. Furthermore, the male member 3 is integrally provided on the surface with a hook member 12 through which a suitable suspender strap 11 is inserted. It is understood that, for easy forming, the male member 3 is blanked out at a portion where the hook 12 is formed.

Figure 2:
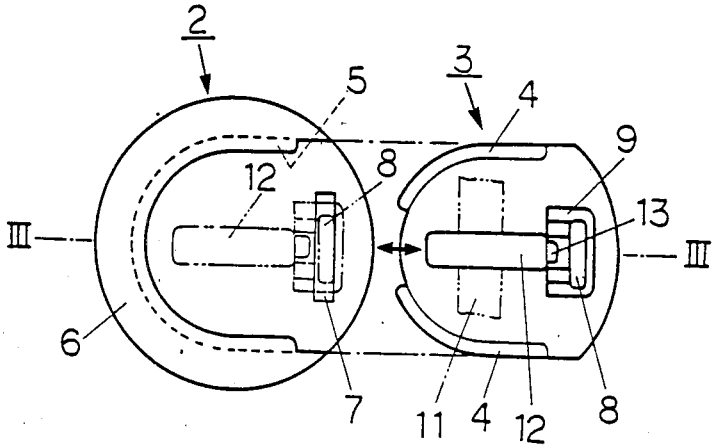
FIG. 2 is an enlarged plan view showing the mount structure of FIG. 1.

Referring to the mount structure of the suspender strap as mentioned above, the required strap 11 is fixedly provided to the hook 12 of the male member 3. Usually, the male member 3 is fitted in and over the female member 2, as shown in FIG. 2 by a phantom line. In that state, the projection 4 is fitted into the retainer groove 5, the operable projection 8 is locked within the hole 7, and the projection 4 or the male member 3 per se is abutted upon the stopper 6 of the female member 2. As a result, the male member 3 is clamped in and held by the operable projection 8 therof, the stopper and retainer groove in the female member 3. Thus, the body 1 of a portable flashlight can be suspended with the strap 11, which is in turn attached to the waist belt of a user.

Figure 4:
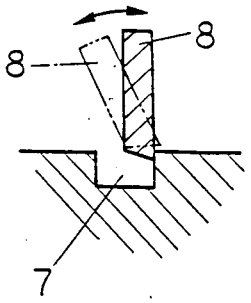
FIG. 4 is a view illustrating the operation of the operable projection shown in FIG. 3.

When the flashlight is used at a position away from the belt in a state where the strap 11 remains attached to the belt, a push is given to the operable projection 8 to disengage it from within the hole 7, as shown in FIG. 4 by a phantom line. In that state, the male member 3 slides toward the side opposite to the stopper 6 to completely pull the projection 4 out of the retainer groove 5. Consequently, the male member 3 disengages from the female member 2 for the separation of the strap 11 from the body 1.

On the contrary, when the female member 2 is connected to the male member 3, the male member is only slid relative to the female member 2 to fit the projection 4 into the retainer groove 5. As a consequence, the operable projection 8 is automatically moved by the female member 2 to a position shown in FIG. 4 by a phantom line. At the point of time when the male member 3 abuts upon the stopper 6, the operable projection 8 is locked within the hole 7, as shown in FIG. 4 by a solid line. Therefore, the male member 3 is again fixed to the female member 2.

As mentioned in the foregoing, the attachment and detachment of the male member 3 can easily be effected by the operation of the operable projection 8. In this connection, it is understood that a projection 13 for the stopper may separately be provided on the hook 12 so as to prevent excessive inclination of the operable projection 8, when it is pulled out of the locking hole 7.

As explained in the foregoing, the arrangement according to the present invention includes a female member attached to the body of a portable flashlight and a male member to be detachably fitted in and over the female member. A suspender strap is attached to the male member which has also an operable projection for permitting it to be released from the female member. Thus, it is very easy to attach or detach the suspender strap to or from the body of the flashlight. Even when the suspender strap remains attached to the waist belt of a user, it is possible to use the flashlight at a position away from the strap. Therefore, it is possible to reduce the length of the suspender strap. Because of the simple structure, they have some advantages that they are easy to manufacture at a low cost.

What is claimed is:

1. A mount structure for a suspender member of a portable flashlight which includes a female member integrally provided on a body of the portable flashlight and a male member detachably fitted over the female member in a sliding manner, said female member having therein a retainer groove into which a first projection of said male member is slidingly fitted from one direction and a stopper member for limiting the movement of said projection, said male member having a second operable projection which can be locked in a locking hole formed in said female member in a state where said first projection is fitted into said retainer groove and restrained by said stopper member of said female member, said second operable projection being resiliently supported in such a manner that it can be engaged within or disengaged out of said locking hole, and being usualy biased for lacking within said locking hole, said male member being fixed relative to the female member with said second operable projection and stopper member in a state where said second operable projection is locked within said locking hole, and said male member having a hook member through which a desired suspender strap is inserted.

* * * * *